US007014190B2

(12) United States Patent
Yu

(10) Patent No.: US 7,014,190 B2
(45) Date of Patent: Mar. 21, 2006

(54) BOARD GAME WITH MOVABLE NEUTRAL PLAYING PIECES

(75) Inventor: Brian Yu, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/858,853

(22) Filed: Jun. 1, 2004

(65) Prior Publication Data

US 2005/0012272 A1 Jan. 20, 2005

Related U.S. Application Data

(60) Provisional application No. 60/475,238, filed on Jun. 2, 2003.

(51) Int. Cl.
*A63F 3/00* (2006.01)

(52) U.S. Cl. ..... 273/243; 273/258

(58) Field of Classification Search ..... 273/243, 273/258, 260, 261

See application file for complete search history.

(56) References Cited

U.S. PATENT DOCUMENTS

| | | | | |
|---|---|---|---|---|
| 436,310 A | | 9/1890 | Hoyt | |
| 2,451,196 A | | 10/1948 | Bruck | |
| 3,455,556 A | | 7/1969 | Mossman | |
| 3,844,563 A | * | 10/1974 | Issac | 273/260 |
| 4,456,261 A | * | 6/1984 | Daitzman | 273/271 |
| 4,480,839 A | * | 11/1984 | Waters, Jr. | 273/258 |
| 4,534,567 A | | 8/1985 | Ferris et al. | |
| 4,570,938 A | | 2/1986 | Ferris et al. | |
| 4,688,802 A | | 8/1987 | Sandifer | |
| 4,982,965 A | | 1/1991 | Dozorsky | |
| 5,150,908 A | | 9/1992 | Codinha | |
| 5,251,905 A | | 10/1993 | Bombino | |
| 5,507,494 A | * | 4/1996 | De Bono | 273/236 |
| 5,984,307 A | | 11/1999 | Fontana | |
| 6,155,566 A | | 12/2000 | Benatti | |
| 6,276,685 B1 | | 8/2001 | Sterling | |

FOREIGN PATENT DOCUMENTS

| | | |
|---|---|---|
| GB | 2149675 | 6/1985 |

* cited by examiner

*Primary Examiner*—Vishu K. Mendiratta
(74) *Attorney, Agent, or Firm*—Kolisch Hartwell, P.C.

(57) ABSTRACT

Board games having movable neutral playing pieces. The board games include tokens that represent each player's location on the board and neutral playing pieces that may be moved by any player to block an opponent's token movement. In some embodiments, the neutral playing pieces may be moved to occupy an adjacent, unoccupied cell, alternatively or additionally, the neutral playing pieces may displace other neutral playing pieces.

19 Claims, 3 Drawing Sheets

BOARD GAME WITH MOVABLE NEUTRAL PLAYING PIECES

CROSS-REFERENCE TO RELATED APPLICATION

This application claims priority under 35 U.S.C. 119(e) to U.S. Provisional Patent Application No. 60/475,238 entitled "Board Game With Movable Neutral Playing Pieces," filed Jun. 2, 2003, the disclosure of which is incorporated herein by reference.

BACKGROUND

Board games provide imaginative fun and entertainment for people of all ages. Many board games require, through the course of play, each player to move a game token that uniquely represents that player on a game board to achieve a predefined goal. Other games provide movable neutral playing pieces primarily for use with sport-simulating games, in the form of a simulated ball or puck; however, in such games the players typically have limited control over the location of the neutral playing pieces. Examples of board games using tokens and/or neutral playing pieces are found in U.S. Pat. Nos. 3,455,556, 4,688,802, 4,982,965, 5,150,908, 5,251,905, 5,984,307, 6,155,566, and 6,276,685, the disclosures of which are incorporated herein by reference, in their entirety and for all purposes.

SUMMARY

The present invention is a board game having movable neutral playing pieces. More specifically, each player has a token that is placed on a corresponding designated starting position on a game board. In some embodiments, the starting positions are located at opposing corners of the game board. Each player tries to overtake the opponent's starting position with his or her own token. Direct movement on the game board from one starting position to the other may be blocked by the opponent's token or by neutral playing pieces, any of which may be moved by either player. In some embodiments, two types of neutral playing pieces are provided, one of which may be moved only into an adjacent, unoccupied cell, and the other of which may push or forcibly displace other neutral playing pieces to occupy an adjacent cell. Therefore, each player may use the neutral pieces strategically to further his or her chances of winning. The game ends when any player overtakes an opponent's starting position.

The advantages of the present invention will be understood more readily after a consideration of the drawings and the Detailed Description.

DETAILED DESCRIPTION AND BEST MODE OF THE DISCLOSURE

Figure 1:
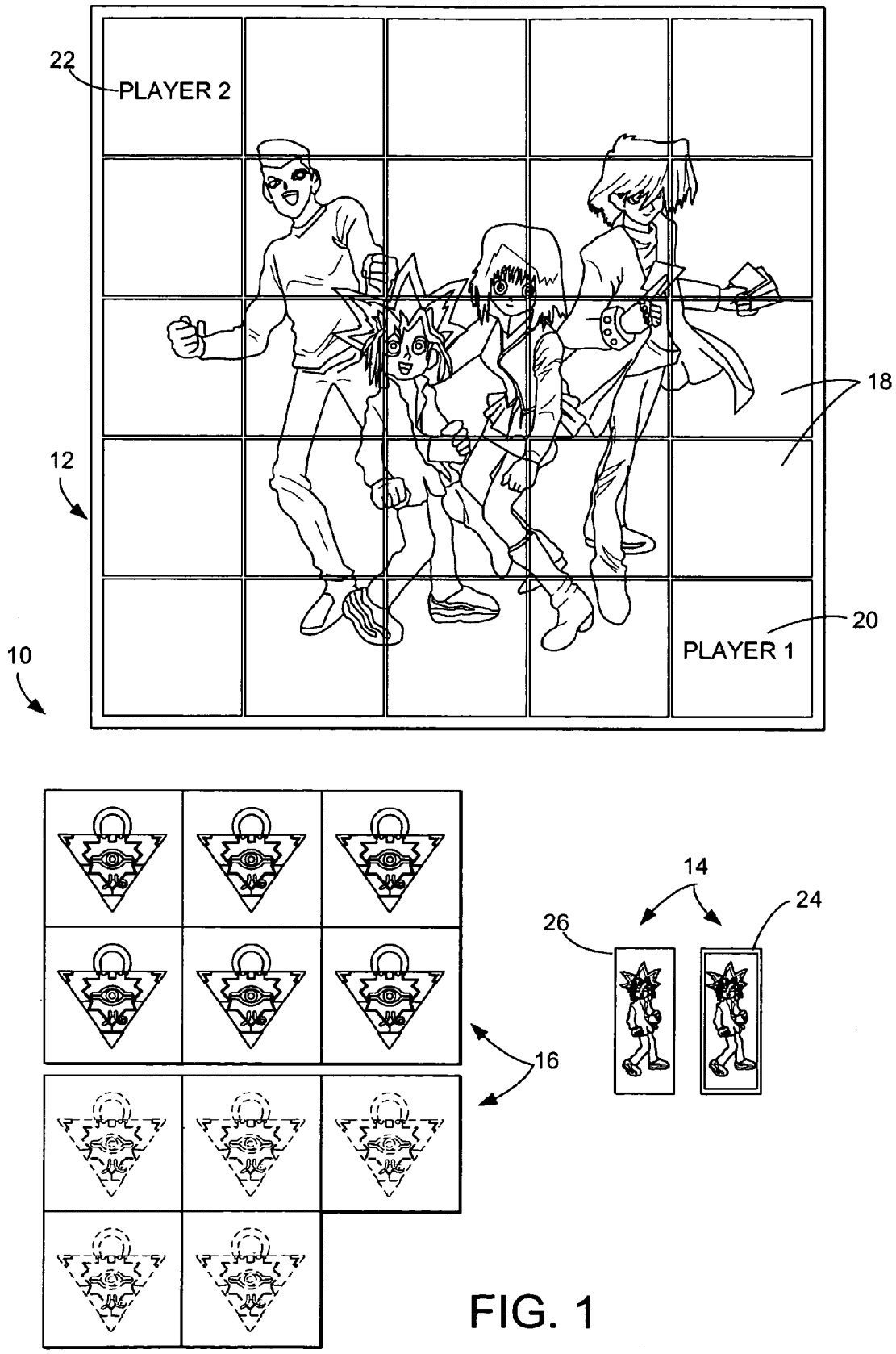
FIG. 1 shows a game according to the present description, including an exemplary game board, tokens, and neutral playing pieces.

A game 10 is shown in FIG. 1 including a game board 12, player tokens 14, and neutral playing pieces 16. Board 12 is divided into a plurality of spaces, generally denoted 18, which may be occupied by either the player tokens or the neutral playing pieces. Some of board spaces 18 may include starting position indicia, such as that designated at 20 and 22, which designate the starting position of each token 14. In some embodiments, the board spaces do not bear indicia, in which case the starting positions may be dictated by the rules of the game or by player consensus. For example, the players may agree to start in opposing corners, anywhere on the board that is at least ten moves away from each other, and the like.

Figure 2:
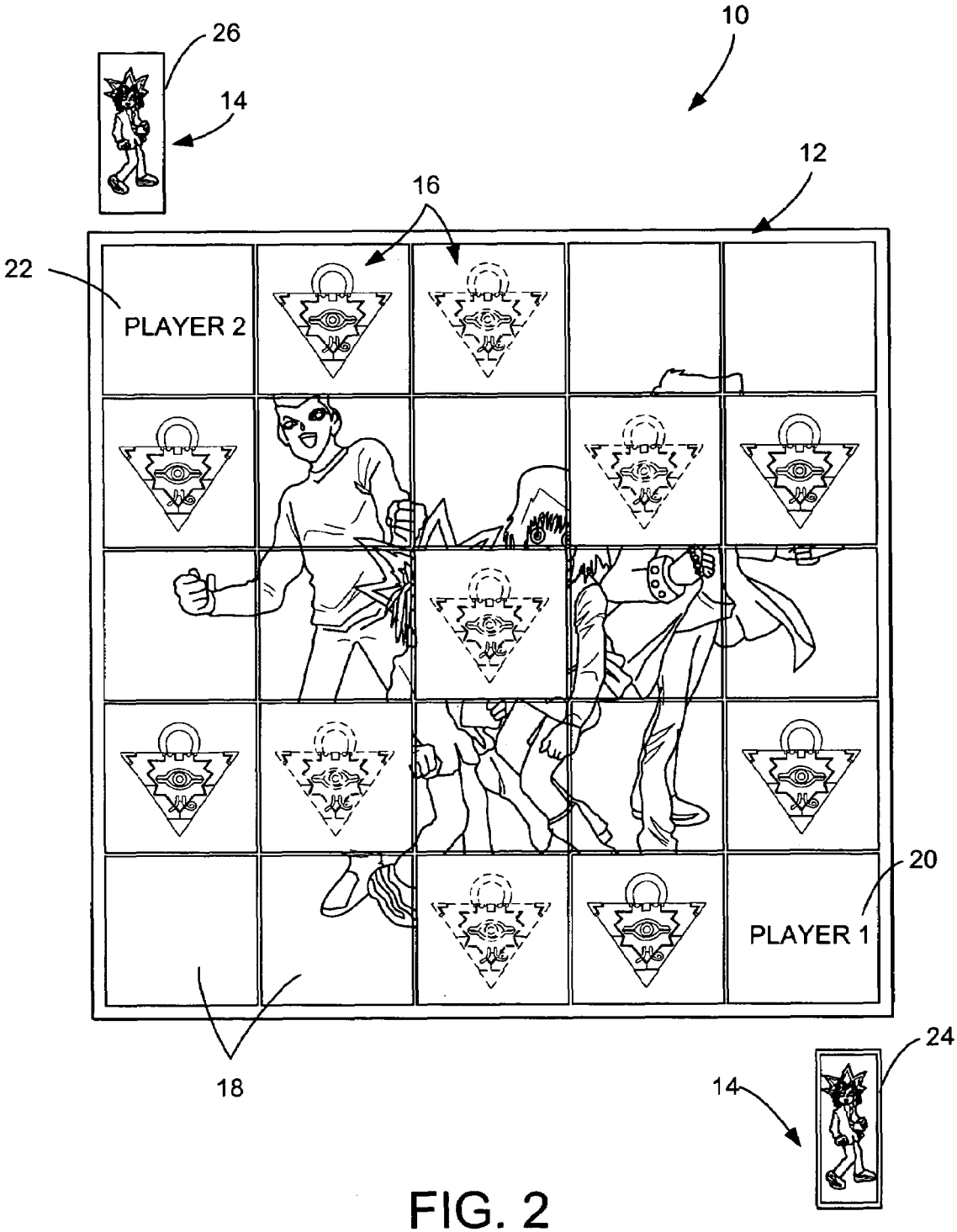
FIG. 2 illustrates the initial setup of the exemplary game components of FIG. 1 with the neutral playing pieces distributed across the game board.

In the example shown in FIG. 2, tokens 14 are placed in starting positions marked by 20 and 22, such as at opposing corners of board 12, to begin the game. In the depicted embodiment, the starting positions are labeled "player 1" and "player 2." Tokens 14 are sized to fit within board spaces 18. Tokens 14 may include player alignment indicia, such as that designated by 24 and 26, indicating an associated player. In some embodiments, player alignment indicia 24 and 26 correspond to starting position indicia 20 and 22. These indicia may include colors, text, graphics, or a combination thereof. Each player typically controls one token over the course of play, although it should be appreciated that the number of tokens may be increased to increase the complexity of the game. The tokens begin the game located at their corresponding starting positions. Each player attempts to be the first to relocate his or her token(s) to the other player's starting position(s).

Figure 3:
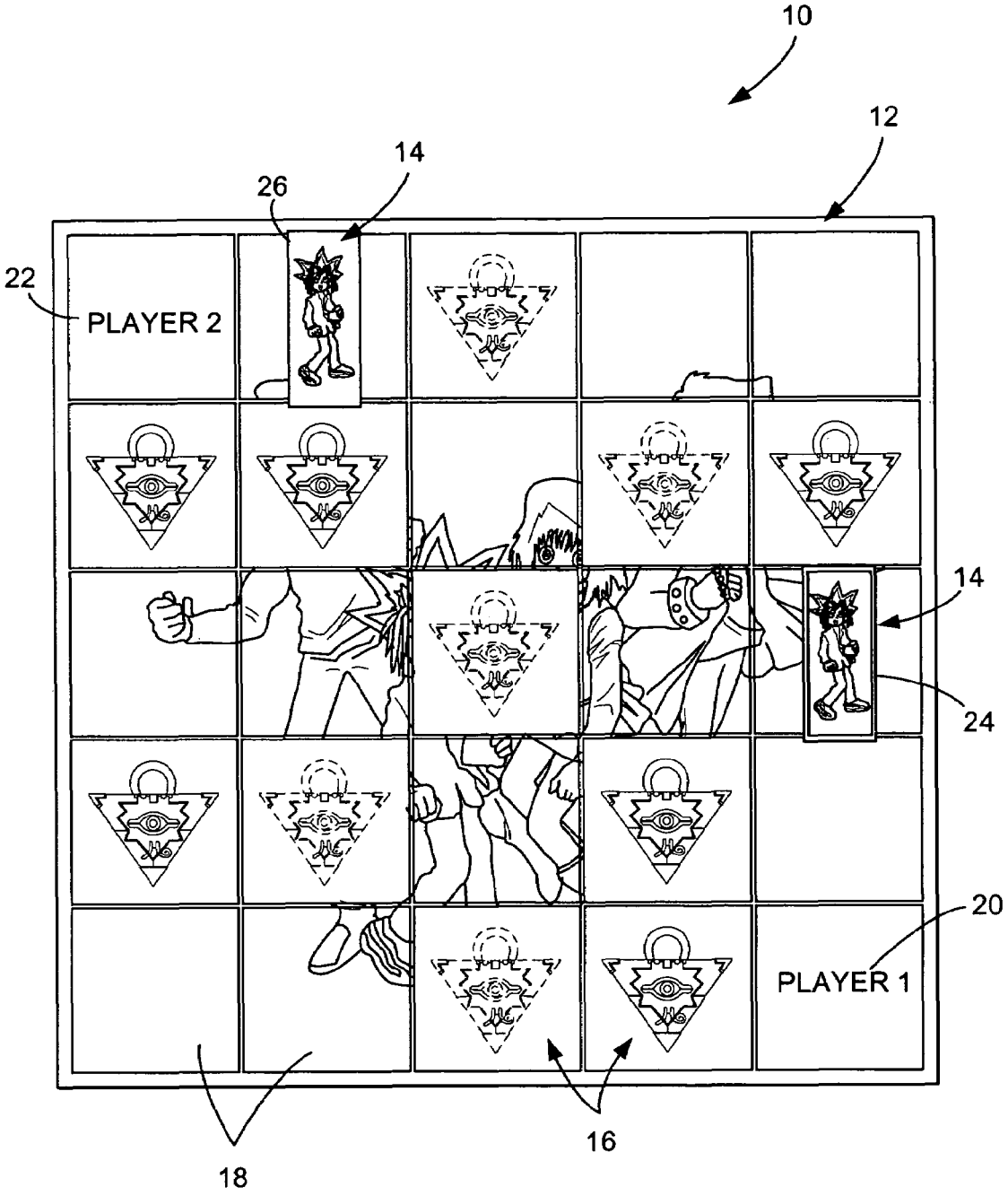
FIG. 3 illustrates movement of the neutral playing pieces and tokens across the game board.

In some embodiments, game board 12 is divided into an equal number of columns and rows, such as that shown in the illustrative example of FIGS. 1–3. However, the number of board spaces 18 may be increased to accommodate more tokens 14 or otherwise increase the complexity of the game. Board 12 may also take other geometric forms, such as the star commonly used in Chinese Checkers. Game board 12 may be constructed from chipboard and may include a crease common to many board games to facilitate folding the board for storage. Artistry may cover the playing surface of the board representing characters familiar to those of the demographic to which the game is marketed.

Direct movement of player tokens 14 from one starting position to the other may be blocked by neutral playing pieces 16, any of which may be moved by either player for strategic purposes. For example, in the initial set-up of one embodiment of the game, neutral playing pieces 16 are blocking movement of both tokens 14, as shown in FIG. 2. Each player therefore needs to clear a path for his or her own token. In so doing, each player will also try to move the neutral playing pieces closer towards his or her opponent's predicted path of travel, thereby increasing that player's chances of being the first to cross the board and reach the opposing starting space. The neutral playing pieces may block movement of tokens or other pieces, and some of the neutral playing pieces may further push a token or playing piece to overtake an adjacent square. In some embodiments the neutral playing pieces are divided into sets, each having different movement rules. In the example shown, neutral playing pieces 16 are divided into two sets, as will subsequently be described. The object of the game is to reach an opponent's starting space before an opponent. The game is over when a player is successful in this endeavor.

During play, the game board is typically placed between the players, who choose at least one token 14 and place them on the designated starting spaces. The neutral playing pieces 16 are spread across the board and serve as "walls" that block the tokens' paths. In embodiments designed for children, the youngest player may go first. Players may choose to move either their token or a neutral playing piece. In some embodiments, player tokens may move a single space; however many movement variations may be employed without departing from the scope of the disclosure. In the example shown, neutral playing pieces 16 are divided into two sets. One set may only move one space at a time into an unoccupied adjacent space 18. The second set of neutral playing pieces 16 may manipulate other neutral playing pieces that are directly adjacent, such as by pushing the adjacent neutral playing piece over another space 18 to create an unoccupied space to overtake.

In some embodiments, diagonal moves are not allowed; however, it should be appreciated that other embodiments of the game may allow diagonal movement, movement across multiple board spaces, and/or movement of one token or neutral playing piece over another. In general, players may not move the neutral playing pieces over the starting positions. Players may also be precluded from returning a neutral playing piece to its prior position directly after it was moved there by an opponent. Play continues until one player maneuvers his or her token(s) across the board to his or her opponent's starting position(s). The first player to do so wins. It should be appreciated that the above description is intended as an example only, and the game may be varied by changing the number and type of allowed moves, and the number of tokens 14 and/or neutral playing pieces 16.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

I claim:

1. A method of playing a board game by at least two players, comprising:

providing a game board divided into spaces, a first set of neutral playing pieces having a first movement pattern and a second set of neutral playing pieces having a second movement pattern that differs from the first movement pattern, each set adapted to be moved by any player, and at least one token adapted to represent each player;

placing each of the at least one token on a designated starting space;

positioning at least one set of neutral playing pieces on the game board; and moving at least one of the at least one token and a member of the at least one set of neutral playing pieces.

2. The method of claim 1, further comprising moving a first neutral playing piece to a board space occupied by a second neutral playing piece, thereby moving the second neutral playing piece to an adjacent unoccupied board space.

3. The method of claim 2, wherein the second neutral playing piece moves in the same direction as the first neutral playing piece.

4. The method of claim 1, wherein the member of the at least one set of neutral playing pieces may not be moved to the board space it occupied immediately prior to its current position.

5. The method of claim 1, further comprising moving the at least one token toward an opposing designated starting space.

6. The method of claim 5, further comprising declaring a winner based on the at least one token reaching the opposing designated starting space.

7. The method of claim 1, wherein the at least one token includes player alignment indicia.

8. The method of claim 7, wherein the designated starting space has starting position indicia that corresponds to the player alignment indicia.

9. The method of claim 1, wherein the game board is divided into an even number of rows and columns.

10. A method of playing a board game by at least two players, comprising:

providing a game board divided into board spaces that form paths between a first starting board space and a second starting board space, a plurality of neutral playing pieces adapted to be moved by any player and including a first set having a first movement pattern and a second set having a second movement pattern that differs from the first movement pattern, a first token adapted to represent a first player, and a second token adapted to represent a second player;

placing the first token on the first starting board space and the second token on the second starting board space;

placing the plurality of neutral playing pieces on remaining board spaces, thereby blocking at least one of the paths between the first and second starting board spaces; and moving at least one neutral playing piece to clear a path between the first and second starting spaces.

11. The method of claim 10, further comprising moving at least one neutral playing piece to block an opponent's path between the first and second starting board spaces.

12. The method of claim 10, wherein the first set of neutral playing pieces may only be moved to an unoccupied board space.

13. The method of claim 10, wherein the second set of neutral playing pieces may be moved to an occupied board space, thereby moving an occupant to an adjacent unoccupied board space.

14. The method of claim 10, wherein the plurality of neutral playing pieces are placed on the game board in a symmetric pattern with respect to the first and second starting board spaces.

15. The method of claim 10, wherein the first and second tokens include player alignment indicia indicating an associated player.

16. The method of claim 15, wherein the first and second starting board spaces include starting position indicia corresponding to the player alignment indicia.

17. An apparatus for playing a game by at least two players, comprising:

a game board divided into a plurality of board spaces;

at least two tokens having player alignment indicia; and a plurality of neutral playing pieces devoid of player alignment indicia and adapted to be moved by any player across the game board, wherein the plurality of neutral playing pieces includes at least a first set having a first movement pattern and a second set having a second movement pattern that differs from the first movement pattern.

18. The apparatus of claim 17, wherein the game board has starting position indicia on at least two of the board spaces.

19. The apparatus of claim 18, wherein the starting position indicia correspond to the player alignment indicia.

* * * * *